US010405088B2

(12) United States Patent
Chen

(10) Patent No.: US 10,405,088 B2
(45) Date of Patent: Sep. 3, 2019

(54) COMBINATION PHASE PLUG, AND COMPRESSION DRIVER AND SPEAKER USING SAME

(71) Applicant: Tymphany Acoustic Technology (Huizhou) Co., Ltd., Huizhou, Guangdong Province (CN)

(72) Inventor: Zhi Chen, Huizhou (CN)

(73) Assignee: TYMPHANY ACOUSTIC TECHNOLOGY (HUIZHOU) CO., LTD., Huizhou, Guangdong Province (CN)

( * ) Notice: Subject to any disclaimer, the term of this patent is extended or adjusted under 35 U.S.C. 154(b) by 0 days.

(21) Appl. No.: 16/001,492

(22) Filed: Jun. 6, 2018

(65) Prior Publication Data

US 2019/0174224 A1 Jun. 6, 2019

(30) Foreign Application Priority Data

Dec. 6, 2017 (CN) ..... 2017 1 1274389

(51) Int. Cl.

| | |
|---|---|
| ***H04R 1/30*** | (2006.01) |
| ***H04R 9/06*** | (2006.01) |
| ***H04R 9/02*** | (2006.01) |
| ***H04R 1/34*** | (2006.01) |
| ***H04R 1/02*** | (2006.01) |

(52) U.S. Cl.

CPC ..... *H04R 1/30* (2013.01); *H04R 1/025* (2013.01); *H04R 1/34* (2013.01); *H04R 9/025* (2013.01); *H04R 9/06* (2013.01); *H04R 2201/34* (2013.01)

(58) Field of Classification Search

CPC ..... H04R 1/347; H04R 1/30; H04R 2201/34; H04R 9/066

See application file for complete search history.

(56) References Cited

U.S. PATENT DOCUMENTS 8,181,736 B2 * 5/2012 Sterling ..... H04R 1/2803 181/176
10,038,954 B2 * 7/2018 Voishvillo ..... H04R 9/066

* cited by examiner

*Primary Examiner* — Amir H Etesam
(74) *Attorney, Agent, or Firm* — Muncy, Geissler, Olds & Lowe, P.C.

(57) ABSTRACT

This application provides a combination phase plug, and a compression driver and a speaker using same. The combination phase plug of this application includes a first phase plug and a second phase plug. The second phase plug is located under the first phase plug. The first phase plug includes a cone, a plurality of first fins, and a plurality of second fins. The first fins and the second fins are located on an outer surface of the cone in a staggered manner. A first gap exists between any first fin and a second fin adjacent to the first fin. The second phase plug includes a round-disc base, a combining portion, and a plurality of second gaps. The combining portion is located in the center of the round-disc base and the combining portion and the cone can be combined with each other. The second gaps are located between an outer edge of the round-disc base and the combining portion. The first gaps are respectively aligned with the second gaps to form a plurality of channels to improve the acoustic performance.

10 Claims, 8 Drawing Sheets

COMBINATION PHASE PLUG, AND COMPRESSION DRIVER AND SPEAKER USING SAME

BACKGROUND

Technical Field

This application relates to phase plug structures, and in particular, to a combination phase plug, and a compression driver and a speaker using the same.

Related Art

In the field of speakers, phase plugs are usually used to change phases of waves to improve the acoustic performance. The basic sound producing principle of a speaker is: a signal is input to a voice coil for generating magnetic field. By means of attraction and repulsion between the voice coil and fixed magnetic poles, the voice coil generates a back-and-forth piston movement in a magnetic gap to vibrate a diaphragm, pushing on the air to create sound waves. As an eardrum of a human ear is innervated by auditory nerves, a sound can be heard after the eardrum receives the sound waves. However, sound waves are not directly scattered outward. Some of the sound waves are sent to a listener after being cross reflected on the diaphragm. Accordingly, standing wave distortion is caused.

A phase plug located between the vibrating diaphragm and a throat can make a resultant wave as waves interfering with each other before the throat. To improve the compression effect and eliminate phase interference, the sound waves of a similar interference direction, similar amplitude, and a similar phase are manifested, thereby to obtain a desirable linear effect.

Therefore, in the field of compression drivers and speakers, various phase plugs capable of improving frequency response are designed, and speakers producing sounds of different frequencies in particular need different phase plugs to change phases, so as to improve the acoustic performance.

SUMMARY

In view of above, this application provides a combination phase plug, a compression driver having the combination phase plug, and a speaker using same.

A combination phase plug of this application includes a first phase plug and a second phase plug. The second phase plug is located under the first phase plug. The first phase plug includes a cone, a plurality of first fins, and a plurality of second fins. The plurality of first fins and the plurality of second fins are located on an outer surface of the cone staggeredly. A first gap exists between any adjacent first fin and second fin. The second phase plug includes a round-disc base, a combining portion, and a plurality of second gaps. The combining portion is located in the center of the round-disc base and the combining portion and the cone can be combined with each other. The second gaps are located between an outer edge of the round-disc base and the combining portion. The first gaps are respectively aligned with the second gaps.

In an embodiment, the combination phase plug includes a fixing member, and the combining portion and the cone can be fixed together by the fixing member.

In an embodiment, the cone includes a conical apex and a conical body, and the first fins and the second fins are located on the conical body.

In an embodiment, the first fins are higher and larger than the second fins.

A compression driver provided in this application includes the combination phase plug, a vibrating diaphragm, a magnetic circuit system, and a housing. The housing covers the first phase plug and the second phase plug. The vibrating diaphragm is located under the second phase plug. The magnetic circuit system includes a voice coil. The magnetic circuit system can be powered on to generate electromagnetic induction, so that the voice coil generates a piston movement to vibrate the vibrating diaphragm vertically. The housing includes an opening. When the vibrating diaphragm vibrates vertically, an acoustic path is formed by the first gaps and the second gaps, so that a resultant wave is output from the opening.

In an embodiment, the vibrating diaphragm is an M-shaped voice diaphragm. The vibrating diaphragm includes a reverse U-shaped fixing portion, and an upper edge of the voice coil is engaged in the reverse U-shaped fixing portion.

In an embodiment, the vibrating diaphragm is an M-shaped voice diaphragm, and the vibrating diaphragm includes at least one double recessed portion.

In an embodiment, the compression driver includes a fixing member, and the combining portion and the cone are fixed together by the fixing member, so as to connect the first phase plug and the second phase plug.

In an embodiment, the conical apex of the first phase plug is near the opening of the housing.

This application further provides a speaker including an exponential horn and the compression driver described above. The compression driver is coupled to the exponential horn. In this embodiment, the speaker is a horn loudspeaker.

In short, an acoustic path formed by the combination phase plug according to this application can improve the compression effect and eliminate phase interference, thereby obtaining a desirable linear effect.

DETAILED DESCRIPTION

For ease of reading, "above", "below", "left", and "right specified in this specification according to the drawings are intended to specify a reference relative position between elements rather than limiting this application.

Figure 1:
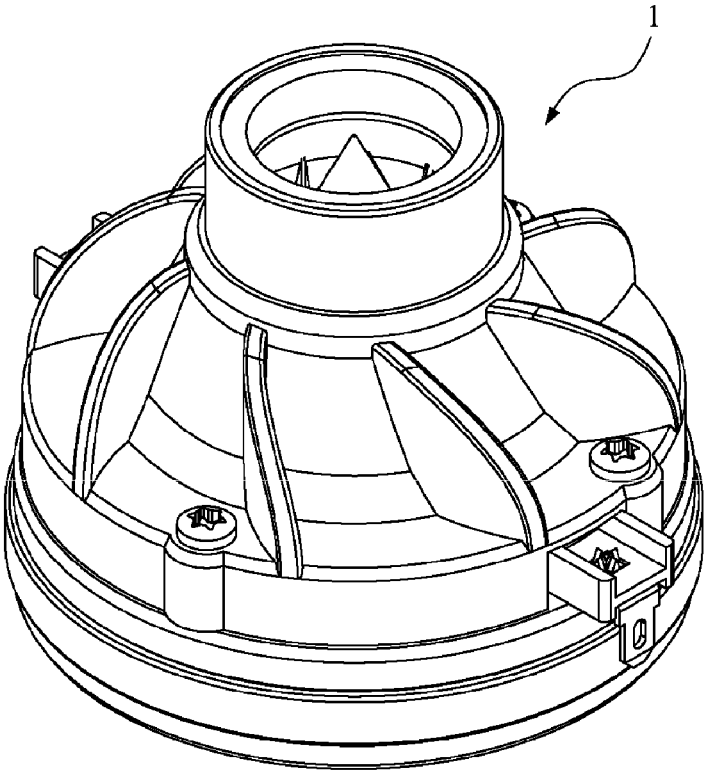
FIG. 1 is a schematic three-dimensional diagram of an embodiment of a compression driver according to this application.
Figure 2:
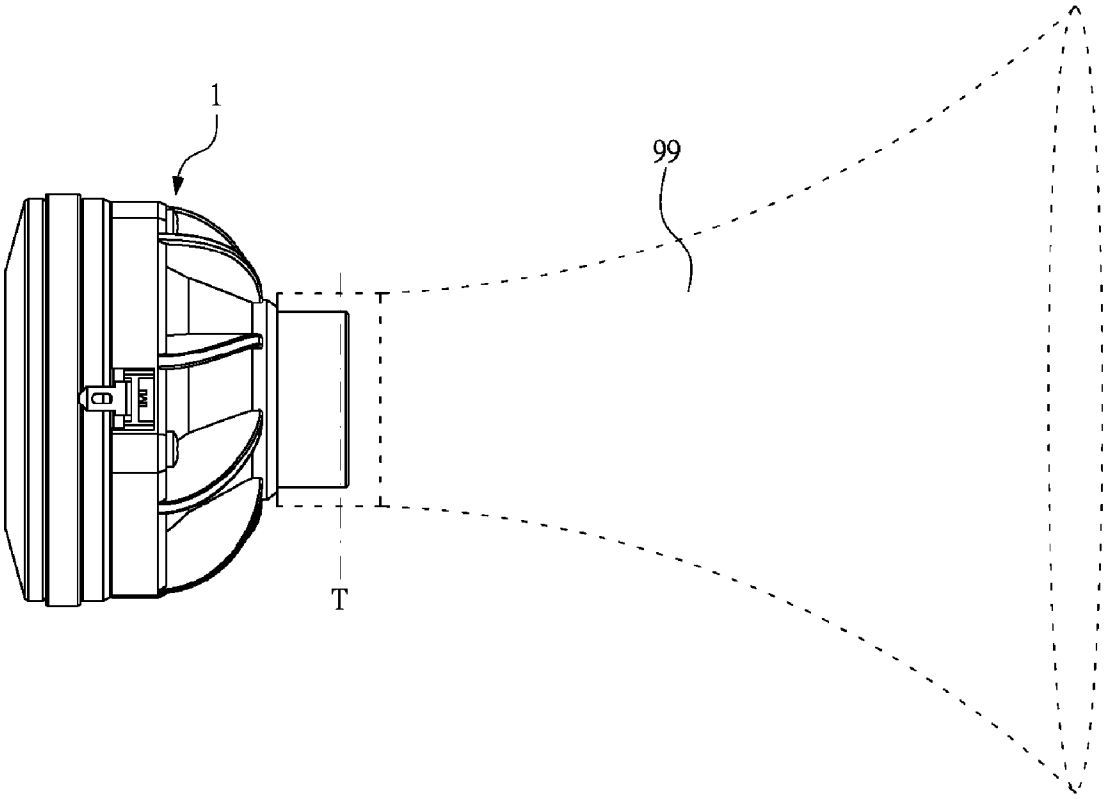
FIG. 2 is a schematic three-dimensional diagram of an embodiment of a speaker according to this application.

FIG. 1 is a schematic three-dimensional outside view of a compression driver 1 having a combination phase plug according to this application. FIG. 2 is a schematic three-dimensional outside view of a speaker with the compression driver 1 having a combination phase plug according to this application. The compression driver 1 is coupled to an exponential horn 99 and is mainly used to compress and conduct air (further description is provided in the following). The compression driver 1 conducts the compressed air to a listening environment by way of a throat portion T and the exponential horn 99. In an embodiment, the speaker is a horn loudspeaker.

Figure 3:
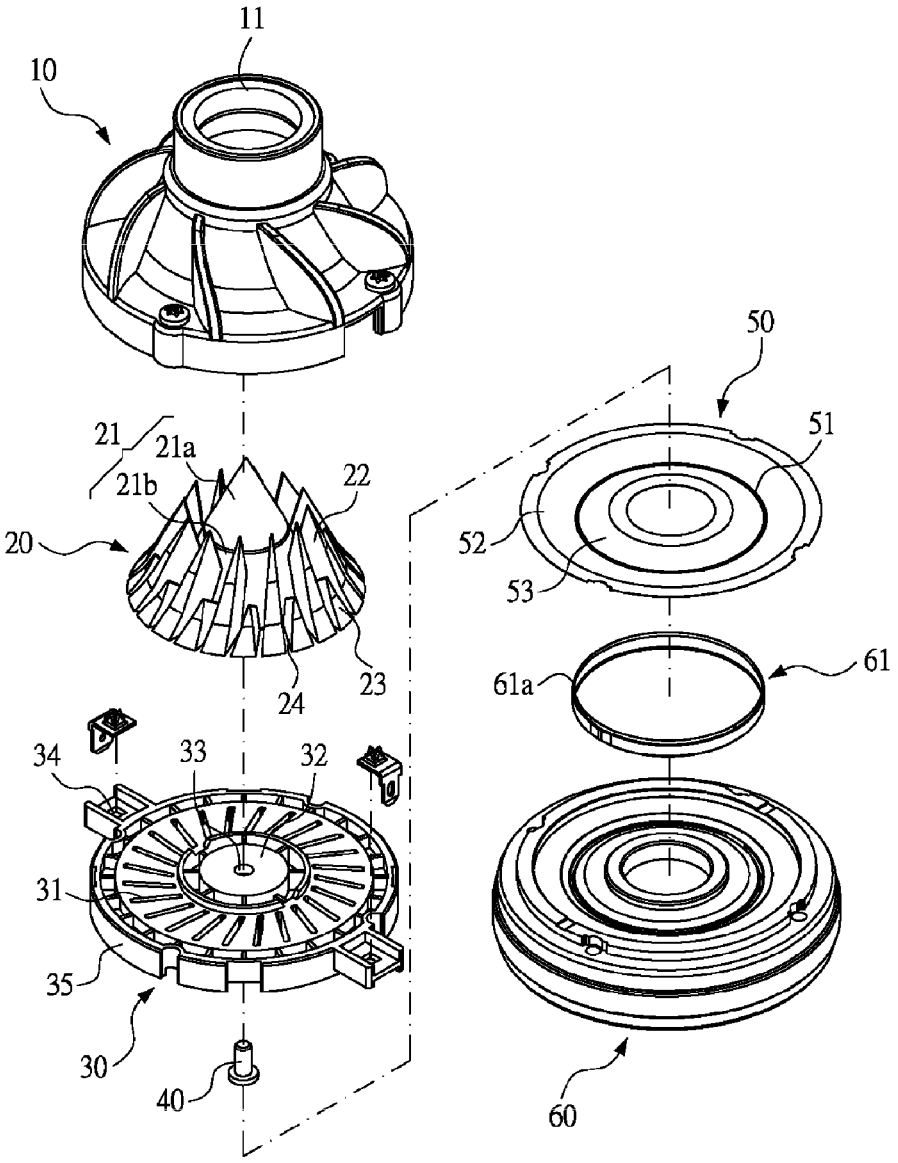
FIG. 3 is a schematic three-dimensional exploded diagram of FIG. 1.

Referring to FIG. 3, the combination phase plug of this application includes a first phase plug 20 and a second phase plug 30. The second phase plug 30 is located under the first phase plug 20. The first phase plug 20 includes a cone 21, a plurality of first fins 22, and a plurality of second fins 23. The first fins 22 and the second fins 23 are located on an outer surface of the cone 21 staggeredly. A first gap 24 is provided between any first fin 22 and a second fin 23 adjacent to the first fin. That is, the first fins 22, the second fins 23, and the first gaps 24 are arranged on the outer surface of the cone 21 in a sequence of the first fin 22, the first gap 24, the second fin 23, the first gap 24, the first fin 22, the first gap 24, and so on. In an embodiment, each first fin 22 and each second fin 23 are substantially triangle and each first fin 22 is higher and larger than each second fin 23. The cone 21 includes a conical apex 21*a* and a conical body 21*b*. The first fins 22 and the second fins 23 are all located on the conical body 21*b*. The fins 22 and 23 can strengthen the structure of the plug and ensure the stability of the structure, so as to improve the acoustic performance.

The second phase plug 30 includes: a round-disc base 35, a combining portion 32, and a plurality of second gaps 31. The combining portion 32 is located in the center of the round-disc base 35. The second gaps 31 are located between an outer edge of the round-disc base 35 and the combining portion 32. The first gaps 24 are respectively aligned with the second gaps 31. The combining portion 32 and the cone 21 can be combined with each other. In an embodiment, the combination phase plug includes a fixing member 40. The combining portion 32 and the cone 21 can be fixed together by the fixing member 40.

Figure 4A:
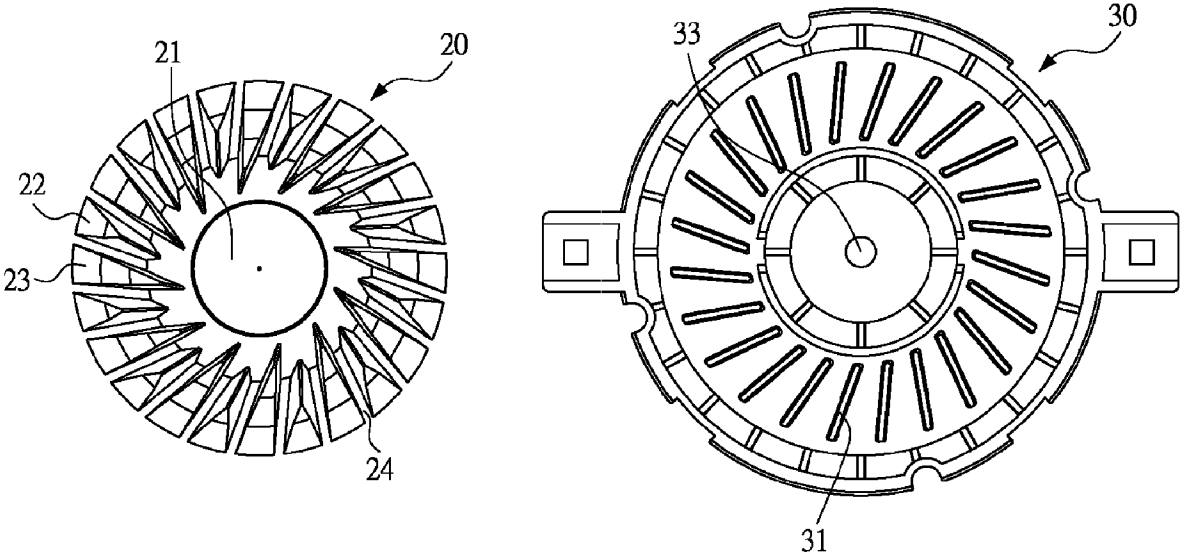
FIG. 4A and FIG. 4B are a top view and a bottom view of a first phase plug and a second phase plug according to this application.
Figure 4B:
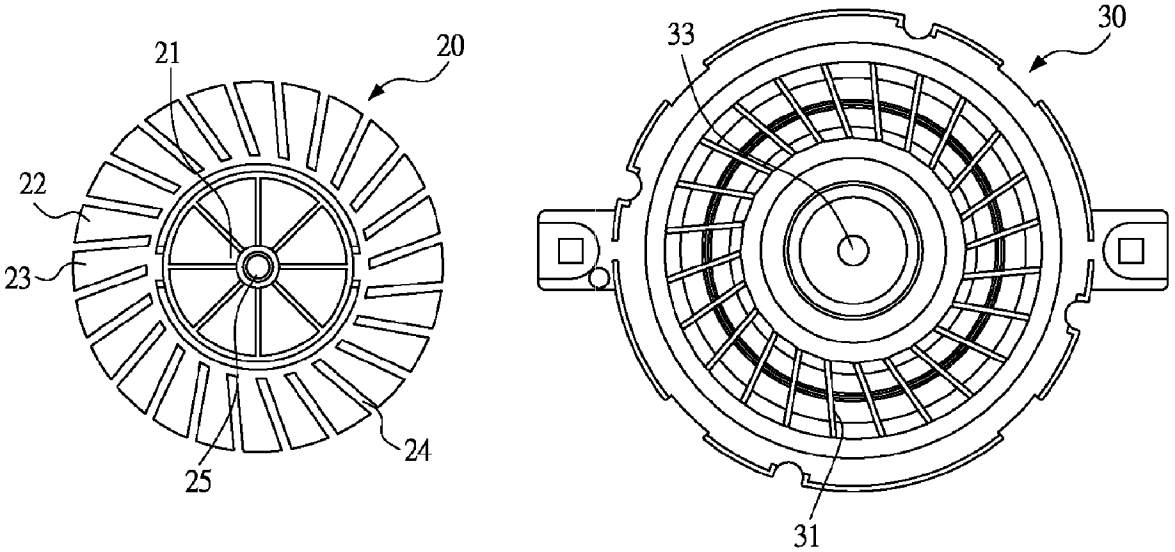

Further, refer to a top view of FIG. 4A and a bottom view of FIG. 4B in terms of the first phase plug 20 and the second phase plug 30. The bottom of the cone 21 of the first phase plug 20 is provided with a tapped hole 25. The bottom of the combining portion 32 of the second phase plug 30 is further provided with a tapped hole 33. The combining portion 32 and the cone 21 may be locked, for example by using a screw 40 (or similarities such as a threaded rod). However, this is merely an example for description, and is not used to limit this application. After reading this specification, a person skilled in the art may understand that the combining portion 32 and the cone 21 may be combined and fixed by using an engaging structure, so as to omit a fixing member (for example, a screw or other similarities). As shown in FIG. 4B, the first fins 22 and the second fins 23 actually have a same bottom area, so that bottom openings of all the first gaps 24 are the same. The first gaps 24 respectively correspond to and align with the second gaps 31. In addition, there is an angle (for example from 60 degrees to 89 degrees) between a radial direction of the first gap 24 and the second gap 31 and a normal direction of the round-disc base 35; that is, the radial direction of the first gap 24 and the second gap 31 is not perpendicular to a tangent line of the round-disc base 35.

Referring to FIG. 3, the compression driver 1 provided in this application includes the first phase plug 20, the second phase plug 30, a vibrating diaphragm 50, a magnetic circuit system 60, and a housing 10. The housing 10 covers the first phase plug 20 and the second phase plug 30. The housing 10 includes an opening 11. The opening 11 may be defined as a throat portion T shown in FIG. 2. The conical apex 21*a* of the first phase plug 20 is near the opening 11 of the housing 10. The first fins 22 and the second fins 23 are all located on the conical body 21*b*. The first gaps 24 are formed between the first fins 22 and the second fins 23. The first gaps 24 of the first phase plug 20 respectively correspond to and align with the second gaps 31 of the second phase plug 30. The vibrating diaphragm 50 is located under the second phase plug 30. The magnetic circuit system 60 includes a voice coil 61.

In an embodiment, the second phase plug 30 includes an extended fixing portion 34. The extended fixing portion 34 may be connected and fixed to both the housing 10 and the magnetic circuit system 60, so that the combination phase plug and the vibrating diaphragm 50 are fixed between the housing 10 and the magnetic circuit system 60.

Figure 6:
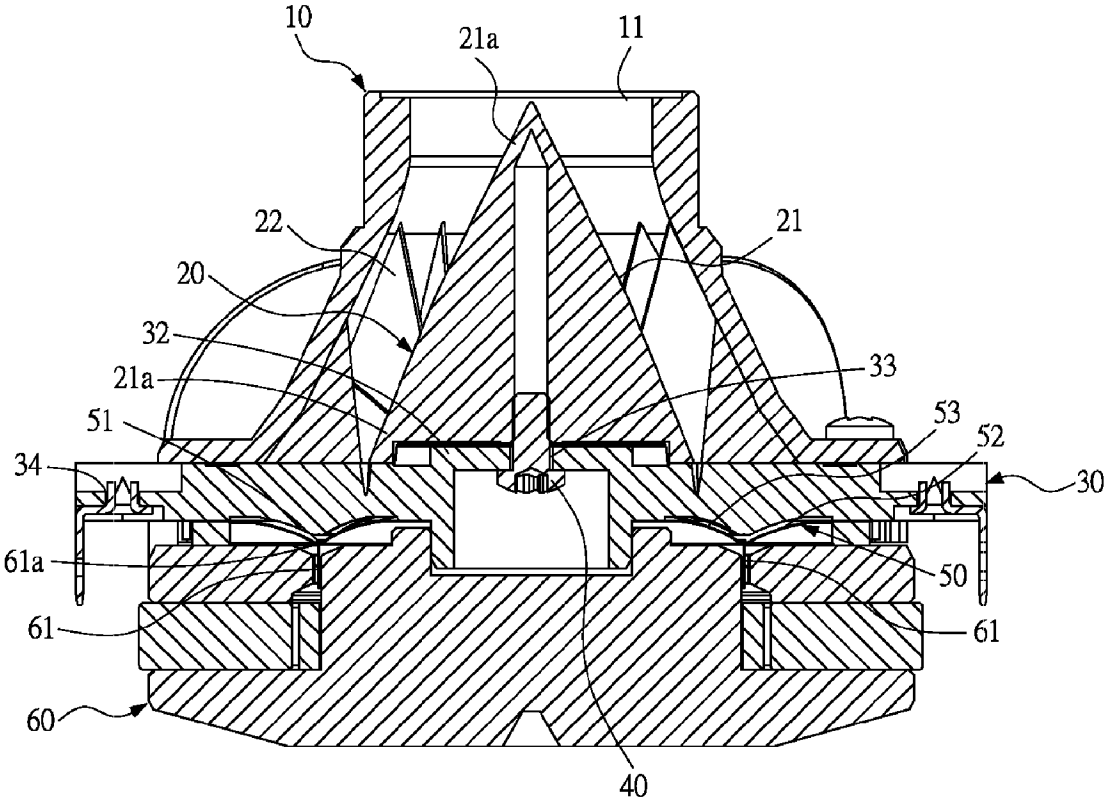
FIG. 6 is a schematic sectional view of FIG. 1.

In addition, referring to FIG. 6, a magnetic circuit system 60 can be powered on to generate electromagnetic induction, so that the voice coil 61 generates a piston movement. An electrical signal is applied to the magnetic circuit system 60 to generate the electromagnetic induction, so that the voice coil 61 generates the piston movement by means of attraction and repulsion interaction between the voice coil 61 and a magnetic pole. This is a common magnetic circuit system, and therefore, the detail of the magnet is not described herein. The voice coil 61 generates the piston movement, so that the vibrating diaphragm 50 may vibrate vertically. When the vibrating diaphragm 50 vibrates vertically, air between the vibrating diaphragm 50 and the phase plugs 20 and 30 is compressed. In this case, a plurality of acoustic paths is formed by the first gaps 24 and the second gaps 31 that are aligned with each other, and the compressed air flows and towards to the opening 11. Finally, resultant waves are formed at the throat portion T and are output from the opening 11.

Figure 5:
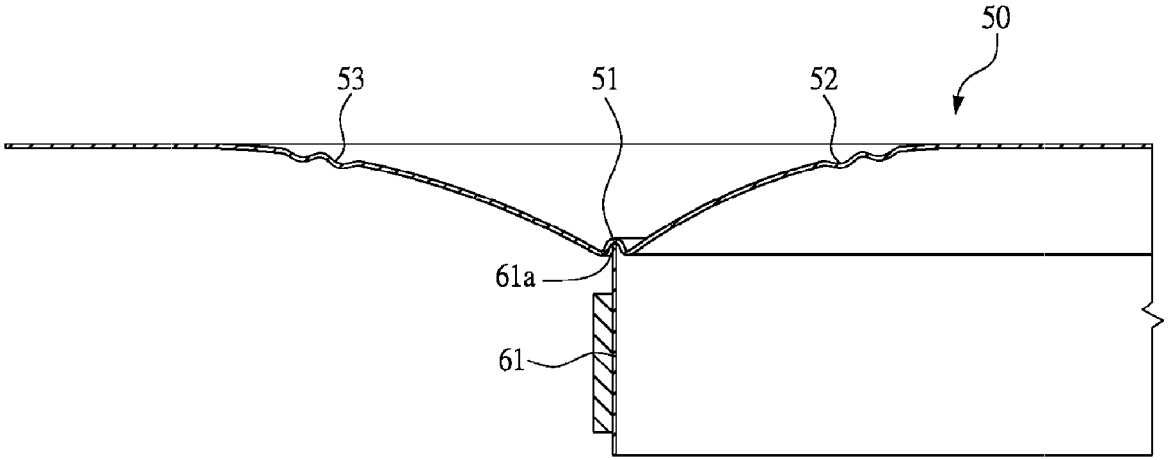
FIG. 5 is a partial schematic sectional view of a vibrating diaphragm and a voice coil according to this application.

Referring to FIG. 5, a vibrating diaphragm 50 of this application is an M-type voice diaphragm. The vibrating diaphragm 50 includes a reverse U-shaped fixing portion 51. An upper edge 61*a* of a voice coil 61 is engaged in the reverse U-shaped fixing portion 51 to strengthen a combination between the vibrating diaphragm 50 and the voice coil 61. In an embodiment, the vibrating diaphragm 50 includes at least one double recessed portion 52, 53. A design of the double recessed portion 52, 53 enables a force applied to the vibrating diaphragm 50 to be more uniform. And the vibrating diaphragm 50 uniformly bears the force when vibrating vertically, so as to obtain better Kms.

Figure 7:
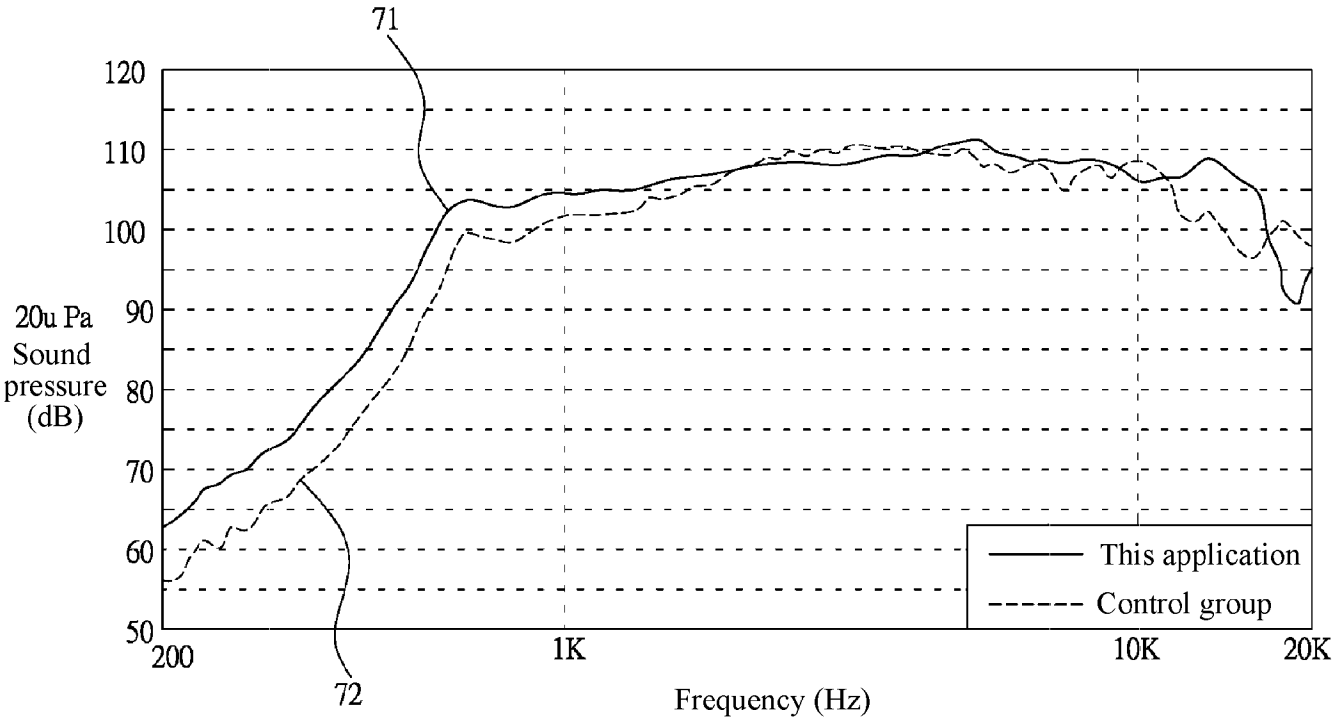
FIG. 7 is a diagram of experimental data comparison of a compression driver according to this application.

Referring to FIG. 7, a sound pressure experiment is performed by using the compression driver 1 according to this application. As shown in FIG. 7, compared with a control group having only one path (shown by a curve 72), the solution of the experiment by using the compression driver 1 according to this application has a much better linear effect (shown by a curve 71).

In short, an acoustic path formed by the combination phase plug according to this application can improve the compression effect and eliminate phase interference, thereby obtaining a desirable linear effect.

Although this application is disclosed as above by using the embodiments, the embodiments are not intended to limit this specification. Any person skilled in the art can make some variations and modifications without departing from the spirit and scope of this application. Therefore, the protection scope of this application should be subject to the scope defined by the appended claims.

What is claimed is:

1. A combination phase plug, comprising:

a first phase plug, comprising:

a cone;

a plurality of first fins, located on an outer surface of the cone; and a plurality of second fins, located on the outer surface of the cone, wherein the first fins and the second fins are arranged staggeredly, and a first gap is provided between any adjacent first fin and second fin; and a second phase plug, located under the first phase plug, and comprising:

a round-disc base;

a combining portion, located in the center of the round-disc base, wherein the combining portion and the cone may be combined with each other; and a plurality of second gaps, located between an outer edge of the round-disc base and the combining portion, wherein the first gaps are respectively aligned with the second gaps.

2. The combination phase plug according to claim 1, wherein the combination phase plug comprises a fixing member, and the combining portion and the cone are fixed together by the fixing member.

3. The combination phase plug according to claim 1, wherein the cone comprises a conical apex and a conical body, and the first fins and the second fins are located on the conical body.

4. The combination phase plug according to claim 1, wherein the first fins are higher and larger than the second fins.

5. A compression driver, comprising:

a housing, having an opening;

a first phase plug, comprising:

a cone;

a plurality of first fins located on an outer surface of the cone; and a plurality of second fins, located on the outer surface of the cone, wherein the first fins and the second fins are arranged staggeredly, and a first gap is provided between any adjacent first fin and second fin; and a second phase plug, located under the first phase plug, and comprising:

a round-disc base;

a combining portion, located in the center of the round-disc base, wherein the combining portion and the cone can be combined with each other; and a plurality of second gaps, located between an outer edge of the round-disc base and the combining portion, wherein the first gaps are respectively aligned with the second gaps;

a vibrating diaphragm, located under the second phase plug; and a magnetic circuit system, comprising a voice coil, wherein the magnetic circuit system can be powered on to generate electromagnetic induction, so that the voice coil generates a piston movement to vibrate the vibrating diaphragm vertically; and the housing covers the first phase plug and the second phase plug, and when the vibrating diaphragm vibrates vertically, an acoustic path is formed by the first gaps and the second gaps, so that a resultant wave is output from the opening.

6. The compression driver according to claim 5, wherein the vibrating diaphragm is an M-shaped voice diaphragm, the vibrating diaphragm comprises a reverse U-shaped fixing portion, and an upper edge of the voice coil is engaged in the reverse U-shaped fixing portion.

7. The compression driver according to claim 5, wherein the vibrating diaphragm is an M-shaped voice diaphragm, and the vibrating diaphragm comprises at least one double recessed portion.

8. The compression driver according to claim 5, wherein the compression driver comprises a fixing member, and the combining portion and the cone are fixed together by the fixing member.

9. The compression driver according to claim 5, wherein the cone comprises a conical apex and a conical body, the conical apex is near the opening, the first fins and the second fins are located on the conical body, and the first fins are higher and larger than the second fins.

10. A speaker, comprising:

an exponential horn; and the compression driver according to claim 1, wherein the compression driver is coupled to the exponential horn.

* * * * *